US010189617B2

(12) United States Patent
Irizarry et al.

(10) Patent No.: US 10,189,617 B2
(45) Date of Patent: Jan. 29, 2019

(54) DISPENSING DEVICE FOR A DRINK BOTTLE

(71) Applicant: Topsters LLC, Temecula, CA (US)

(72) Inventors: Mario Junior Irizarry, Temecula, CA (US); Daniel Howard, Temecula, CA (US)

(73) Assignee: Topsters LLC, Temecula, CA (US)

( * ) Notice: Subject to any disclaimer, the term of this patent is extended or adjusted under 35 U.S.C. 154(b) by 0 days.

(21) Appl. No.: 15/849,500

(22) Filed: Dec. 20, 2017

(65) Prior Publication Data

US 2018/0178958 A1 Jun. 28, 2018

(30) Foreign Application Priority Data

Dec. 22, 2016 (AU) ..... 2016905316

(51) Int. Cl.

| | |
|---|---|
| ***B65D 25/08*** | (2006.01) |
| ***B65D 51/28*** | (2006.01) |
| ***B65D 47/06*** | (2006.01) |
| ***B65D 43/02*** | (2006.01) |
| ***A61J 11/04*** | (2006.01) |
| ***B65D 47/08*** | (2006.01) |

(52) U.S. Cl.

CPC ..... *B65D 51/2835* (2013.01); *A61J 11/04* (2013.01); *B65D 43/0231* (2013.01); *B65D 47/061* (2013.01); *B65D 47/08* (2013.01); *B65D 2543/00537* (2013.01)

(58) Field of Classification Search

CPC .... B65D 25/085; B65D 25/087; B65D 25/08; B65D 51/2814; B65D 51/2835; B65D 51/285; A61J 1/2093

USPC ..... 206/219, 222

See application file for complete search history.

(56) References Cited

U.S. PATENT DOCUMENTS

| | | | | |
|---|---|---|---|---|
| 7,828,140 | B2 * | 11/2010 | Lee | B65D 47/063 206/219 |
| 8,230,777 | B2 * | 7/2012 | Anson | B65D 47/243 220/501 |
| 2008/0202951 | A1 | 8/2008 | Landolt et al. | |
| 2009/0255897 | A1 | 10/2009 | Buczkowski | |

(Continued)

OTHER PUBLICATIONS

International Search Report and Written Opinion received International Application No. PCT/US17/67747 dated Mar. 1, 2018.

*Primary Examiner* — King M Chu

(74) *Attorney, Agent, or Firm* — Knobbe, Martens, Olson & Bear, LLP

(57) ABSTRACT

A formulation dispensing device can include a cartridge receptacle to accommodate and/or secure a beverage ingredient cartridge and permit contents within the cartridge to flow into a bottle or beverage container. Additionally, a formulation dispensing device can include a drink through valve that can permit mixed contents from a beverage container to flow through the drink through valve and be consumed. For example, the formulation dispensing device can include ingredients that can be added to a range of different drinks, including sports drinks, dietary drinks, and as a critical life supporting drinks in humanitarian situations. The formulation dispensing device can also include a lid configured to pivot between open and closed positions and can seal the dispensing device which allows the beverage container to be inverted during consumption without leakage through the first aperture.

20 Claims, 9 Drawing Sheets

(56) References Cited

U.S. PATENT DOCUMENTS

| | | | |
|---|---|---|---|
| 2015/0166239 | A1 | 6/2015 | Dabah et al. |
| 2015/0203260 | A1 | 7/2015 | Kim et al. |
| 2015/0282654 | A1 | 10/2015 | Kurabe et al. |

* cited by examiner

DISPENSING DEVICE FOR A DRINK BOTTLE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTIONS

Field of the Inventions

The present inventions relate to dispensing devices that can dispense a formulation into a drinking bottle.

Description of the Related Art

Formulations can be added to a range of different drinks, including sports drinks, dietary drinks, and as life supporting drinks in humanitarian aid efforts. In the case of sports drinks, formulations can be added to enhance strength and endurance of the athlete, replace glucose, replace sweat, and support muscle growth. In the case of dietary supplements, formulations can be added to drinks to provide essential nutrients, vitamins, proteins, essential fats and possibly medicaments. Generally speaking, formulations can be added to liquids for many purposes from disinfecting unsafe drinking water to provide potable water at one end of the spectrum to providing flavors of no nutritional benefit.

Formulations are often delivered in loose powders that are either spooned into a drinking bottle or deployed as tablets from satchels or blister packets. Formulations deployed as tablets from satchels or blister packets are commonly spilt and/or unknowingly contaminated. In addition, in humanitarian aid efforts it can be difficult to deploy large volumes of potable drinking liquid using conventional practices.

SUMMARY OF THE INVENTION

An aspect of at least one of the inventions disclosed here includes the realization that current methods and techniques for adding formulations into beverage container can result in spilling or allow contamination. The present disclosure relates to a beverage ingredient dispensing device and cartridge for dispensing a formulation into a beverage container which solves the problems faced by these current methods and techniques for adding formulations to beverage containers.

The dispensing device disclosed herein can include a removable lid assembly configured to engage a beverage container, wherein the beverage container comprises a body and a top portion having a first opening defining a first internal volume which can be configured to contain a liquid beverage. The removable lid assembly can secure to the top portion of a beverage container and over the first opening. The removable lid assembly can include a top surface, a cartridge receptacle, a collar, an outer wall, a drink through valve, a cover, and a cartridge.

The cartridge receptacle can include an upper end including a first aperture having a perimeter and being located on the top surface, a lower end including a second aperture, and an interior sidewall defining a second internal volume between the upper and lower ends. The interior sidewall can be cylindrical and thus sized to accommodate a cylindrical beverage ingredient cartridge. The cartridge receptacle can further include an inner flange positioned at the lower end and proximate to the second aperture. Further, the second internal volume and the first aperture can be sized to allow a beverage ingredient cartridge to be inserted through the first aperture and into the second internal volume. The cartridge receptacle can also be configured to allow a beverage ingredient in the beverage ingredient cartridge to flow through the second aperture and into the beverage container. The inner flange of the cartridge receptacle can define a stop preventing the beverage ingredient cartridge from falling through the lower end of the cartridge receptacle into the first internal volume of the beverage container.

The removable lid assembly of the beverage container and dispensing device can include a collar extending upwardly from the top surface and around the perimeter of the first aperture of the upper end of the cartridge receptacle.

The removable lid assembly can include an outer wall extending downwardly from the top surface and comprising an inwardly facing surface configured to engage the top portion of the beverage container. In accordance with some embodiments, the inwardly facing surface of the outer wall comprises a screw thread for engaging a corresponding screw thread located on the top portion of the beverage container. The inwardly facing surface of the outer wall can be configured to engage the top portion of the beverage container with other securement or sealing methods or structures. The outer wall of the dispensing device can comprise different shapes. For example, the outer wall can be cylindrical.

The removable lid assembly can include a drink through valve comprising a stem and a valve member movably mounted to the stem between opened and closed positions. The stem of the drink through valve can include a passage extending through the top surface and a second opening, wherein the valve member closes the second opening when in the closed position and is spaced from the passage when in the open position. The stem and valve member of the drink through valve can define a push pull closure to allow contents from the beverage container to pass through the drink through valve when the push pull closure is in the open position and prevent contents from the beverage container from passing through the drink through valve when the push pull closure is in the closed position. The drink through valve can be positioned on the top surface of the removable lid assembly spaced from the first aperture on the top surface.

The removable lid assembly of the beverage container and dispensing device can include a cover which can be considered to be a "lid" or "pivoting lever" pivotably mounted to the top surface of the removable lid assembly configured to pivot between open and closed positions. The cover can include a cover perimeter and a skirt extending around the cover perimeter, wherein when the cover is in the closed position, the cover covers the first aperture on the top surface and the skirt is configured to engage the collar on the top surface and form a sealing engagement which allows the beverage container to be inverted during consumption without leakage through the first aperture. In accordance with some embodiments, the lid can be pivotably mounted to the top surface at a connection location and the drink through valve can be positioned closer to the first aperture than to the connection location. Alternatively, in other embodiments the drink through valve can be positioned closer to the connection location than to the first aperture.

The removable lid assembly of the beverage container and dispensing device can include a beverage ingredient cartridge comprising a cartridge body defining a third internal volume, a cartridge opening, and a frangible sealing membrane that covers the cartridge opening and seals the third internal volume defined by the cartridge body. The third internal volume can contain a formulation of beverage ingredients mixable with liquid contents of the beverage container. In some embodiments, the third internal volume of the beverage ingredient cartridge can include up to 40 grams of formulation and suitably in the range of 20 to 30 grams of formulation. In accordance with some embodiments, the cartridge can be removable from the lid assembly.

In accordance with some embodiments, the dispensing device can include a supporting assembly, which can be considered to be a "lid assembly" that engages a neck of a bottle and a cartridge. The neck can be considered to be a "top portion," the bottle can be considered to be a "beverage container," and a cartridge can be considered to be a "beverage ingredient cartridge." The cartridge can have a receptacle body and a sealing membrane that covers and seals an opening in the receptacle body to form a sealed chamber containing a known quantity of formulation to be added to the contents of the bottle. The sealed chamber can be considered to be an "internal volume." The sealing membrane can be frangible. The cartridge can have an opening mechanism that is operable to open the sealing membrane to allow the formulation to be discharged from the cartridge into the bottle, wherein the supporting assembly interconnects with the cartridge and supports the cartridge at an upper end of the bottle and with the opening of the cartridge facing into the bottle.

One of the optional advantages of this embodiment is that the opening mechanism can face outwardly of the bottle to allow a user to operate the opening mechanism which will cause the formulation to be discharged into the bottle without handling the formulation. For example, there is no need for a user to spoon or deploy the formulation from a satchel or blister packet.

In accordance with some embodiments, the supporting assembly and the cartridge can be separable to allow the cartridge to be replaced with a fresh cartridge when required. This configuration provides the benefit of allowing the formulation of multiple cartridges to be added to the contents of the bottle using the same supporting assembly. When multiple cartridges are used, the cartridges can contain the same formulation or different formulations, depending on the requirements and the condition of the liquid in the bottle.

The supporting assembly can include an inner body including first portion that engages the neck of the bottle to locate the supporting assembly on the bottle and a second portion that engages the cartridge to locate the cartridge at least partially in the neck of the bottle.

The first portion of the inner body can include an outer flange, such as an outer annular flange, for engaging the opening of the bottle and the second portion can include an inner flange, such as an inner annular flange that defines an inner aperture. In an embodiment, the inner aperture can be sized to communicate with the opening of the cartridge but prevent the cartridge from being received by the aperture. In another embodiment, the inner aperture can be sized so that the cartridge can be received in the aperture.

The outer flange and the inner flange can be interconnected by bridging members that are arranged to locate the inner flange inwardly of the opening of the bottle and thereby support at least part, and preferably the entire cartridge inside the opening of the bottle. The bridging members of the supporting assembly can be separated by gaps to allow the passage of the contents of the bottle through the supporting assembly. In one embodiment, the bridging members can be linear and radially directed of the outer annular flange. In another embodiment, the bridging members can include an L-shape formation.

The first portion of the supporting assembly can be fixedly connected to the neck of the bottle. Suitably, the supporting assembly can be fixedly connected to a rim of an opening of the bottle. In one example, the first portion of the supporting assembly can be plastics welded to the bottle, and suitably to the rim of the opening of the bottle. In another example, the first portion of the supporting assembly can be adhered by an adhesive to the neck of the bottle, suitably to the rim of the opening of the bottle.

The supporting assembly, in some embodiments, does not provide a closure for the bottle, and after the sealed chamber has been opened by the opening mechanism and the formulation discharged into the bottle, a closure can be fitted to the bottle and shaken. For example, the closure can be a conventional screw cap such as a cap having a teat for feeding a baby, a cap having a straw, a cap having an openable closure such as a pull closure that can move between opened and closed positions.

The supporting assembly can include a cap closure that fits over the inner body whilst the inner body engages the neck of the bottle in an operative position for supporting the cartridge. The cap closure can have a top wall which can be considered to be a "top surface" and an outer skirt which can be considered to be an "outer wall" extending from the top wall in which the outer skirt has an inwardly facing screw thread for co-operating with a screw thread on the neck of the bottle, and in which the top wall has an aperture that aligns with an opening in the supporting assembly to allow a user to operate the opening mechanism.

In some embodiments, the opening in the top surface of the cap closure can be configured so that the top surface extends over the top wall of the cartridge adjacent to the opening mechanism and prevents the cartridge from being removed from the supporting assembly. The cartridge can be separated from the supporting assembly after the cap closure has been removed.

In some embodiments, the opening in the top surface of the cap closure can be configured to allow the cartridge to pass through the opening (including an outer peripheral flange of the cartridge). This can allow the cartridge to be replaced with a fresh cartridge when required without having to remove the cap closure.

The cap closure can also include a nozzle which can be considered to be a "drink through valve" extending from the top surface that can be opened and closed to allow a user to consume the contents of the bottle. The nozzle can include any suitable closure such as a removable screwed cap or a slider piece that can be moved between an opened extended position to allow consumption of contents of the bottle and a closed retracted position. As discussed above, the drink through valve can comprise a stem and a valve member movably mounted to the stem between opened and closed positions. The nozzle can be asymmetrically located on the cap closure or positioned on the top surface of the closure cap spaced from the opening in the top surface.

The cap closure can also include a pivoting lever which can be considered to be a "cover" or "lid" that can be pressed by a user to operate the opening mechanism. Suitably, the opening mechanism includes a switch in the form of a button which is pressed as described above. The pivoting lever can be pressed down onto the button. The pivoting lever can also have a skirt formation which can be considered to be a "skirt" extending around a perimeter of the pivoting level that can make sealing engagement with an opening in the top surface of the cap closure to form a liquid seal so that the contents of the bottle are contained within the bottle during consumption.

The supporting assembly can be arranged to position the cartridge so as to extend at least partially through the opening of the bottle, and suitably completely below the opening of the bottle. In other words, the cartridge can be partially or completely located below an opening of the bottle. A benefit this can provide is that the formulation, when dispensed from the cartridge will be directed into the bottle.

In another embodiment, the supporting assembly and the cartridge can be fixedly interconnected to prevent separation. For instance, the supporting assembly and the cartridge can be integrally formed by way of, for example, plastic molding. In this situation, it is intended that the dispensing device be used once only, following which the device can be discarded, or preferably recycled using plastics recycling technology. In this embodiment, the supporting assembly and the receptacle body of the cartridge can be integrally formed, for example, from a moldable material, ideally a polymer and even more ideally a moldable plastic. The supporting assembly can include a top wall and an outer skirt extending from the top wall having an inwardly facing screw thread for co-operating with the thread on a bottle neck, and an inner skirt extending from the top wall defining the receptacle body of the cartridge. In this embodiment, the supporting assembly includes features that provide a closure that can be fitted to the bottle whilst the formulation is being discharged into the bottle, and after the formulation has been discharged into the bottle and the contents of the bottle can be consumed.

The supporting assembly can also include a nozzle extending from the top wall that can be opened and closed to allow a user to consume the contents of the bottle. The nozzle can include any suitable closure such as a removable screwed cap or a slider that can be moved between an opened advanced position to allow consumption of contents of the bottle and a closed retracted position. The inner skirt and the nozzle can be arranged asymmetrically relative to the top wall of the supporting assembly.

The opening mechanism can include a switch facing outwardly from the cartridge which can be operated by the user to cause the sealing membrane to be broken. The opening mechanism suitably includes a load bearing edge that is connected to the switch and when the user operates the switch, the load bearing edge will be advanced towards and engages the sealing membrane causing the sealing membrane to open.

In one embodiment, the switch is a button that can be pressed by the user, the button being interconnected to the load bearing edge via an arm, and the arm and the load bearing edge are located within the receptacle body of the cartridge containing the formulation. A user pressing the button will move the load bearing edge in a sliding action towards and onto the sealing membrane causing the sealing membrane to break.

In another embodiment, the switch can be a dial that in use is turned by the user, the dial being interconnected to the load bearing edge via a screw threaded portion located inside the receptacle which cooperates with a corresponding screw threaded portion on an inside face of the receptacle body. A user turning the dial can cause the screw threaded portion, and cause the load bearing edge to be advanced toward the sealing membrane. In other words, in operation the switch is operable to cause the sealing membrane to be broken from within the receptacle containing the formulation.

When the switch is in the form of a dial, ideally the cartridge and the supporting assembly include interfitting formations that engaged when the cartridge is received by the supporting assembly in an operative position. The interfitting formations prevent the cartridge and the supporting assembly from rotating relative to each other.

The sealing membrane can be a rigid membrane or a flexible membrane. The sealing membrane can include lines of preformed weakness which the opening mechanism breaks to open the sealing membrane. The sealing membrane can be adhered to a perimeter of an opening of the receptacle body, and the opening mechanism can be operable to break the adhesion between the sealing membrane and the receptacle body to open the sealing membrane.

The dispensing device can include a protective cap that can be frangibly connected to the supporting assembly. The protective cap can be removed from the supporting assembly by a user pulling or twisting the protective cap from the supporting assembly. Once the protective cap has been severed from the supporting assembly, this will indicate to a user that the dispensing device can have been used previously.

The dispensing device can also include a tamper evidence band having teeth that engage cooperating formations on an outer face of the bottle when the dispensing device is located in a closed position on the bottle. The tamper evidence band can be connected to the dispensing device by frangible connections. Upon removal of the dispensing device from the bottle, for example, unscrewing the dispensing device, the tamper evidence band can be retained in the bottle by the teeth engage the co-operating formations on the bottle which prevent the tamper evidence band from rotating, causing the frangible connections to break.

When the frangible connections are broken, this will indicate to a user the supporting assembly has been removed from the bottle and to be cautious, and possibly discard the bottle. The tamper evidence band can also include a lip that engages a flange extending about the bottle, preventing the band from sliding off the bottle.

An embodiment of the present invention also relates to a replaceable cartridge that can be used with a supporting assembly that engages the top portion of a bottle. The replaceable cartridge can include a receptacle body which can be considered a "cartridge body," a sealing membrane which can be considered a "frangible sealing membrane," and an opening mechanism. The sealing membrane can cover and seal an opening in the receptacle body to form a sealed chamber containing a quantity of formulation to be added to contents of the bottle. The opening mechanism can be operable to open the sealing membrane to allow the formulation to be discharged from the cartridge into the bottle, wherein the cartridge can be seated on the supporting assembly which supports the cartridge at an upper end of the bottle and with the opening of the cartridge facing into the bottle. The replaceable cartridge described in the paragraph immediately above can include any one or a combination of the features of the dispensing device described herein.

While certain aspects, advantages and novel features of embodiments of the inventions are described herein, it is to be understood that not necessarily all such advantages can be achieved in accordance with any particular embodiment of the inventions disclosed herein. Thus, the inventions disclosed herein can be embodied or carried out in a manner that achieves or selects one advantage or group of advantages as taught herein without necessarily achieving other advantages as can be taught or suggested herein.

BRIEF DESCRIPTION OF THE DRAWINGS

Embodiments disclosed herein are described below with reference to the drawings. Throughout the drawings, reference numbers are re-used to indicate correspondence between referenced elements. The drawings are provided to illustrate embodiments of the inventions described herein and not to limit the scope thereof.

DETAILED DESCRIPTION OF THE PREFERRED EMBODIMENT

Figure 1:
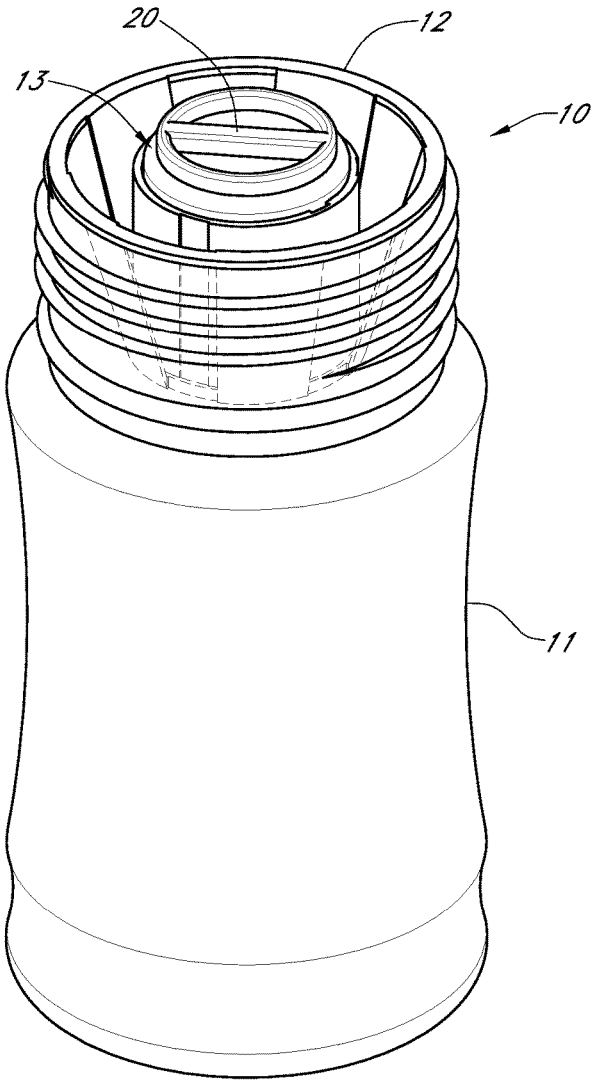
FIG. 1 is a side and top perspective view of a dispensing device according to an embodiment including a separable supporting assembly and cartridge that are fitted into the top portion opening of a bottle.

A number of embodiments of the present inventions are described below with reference to the accompanying drawings. In the following text, reference numerals have been used to help identify corresponding features in the figures. In some instances, the same reference numerals have been used in each of the embodiments to identify the same or similar features. However, in order to maintain the clarity of the figures, not all of the reference numerals have been used in each figure.

The dispensing devices shown in FIGS. 1 to 7 can be used with a bottle which can be considered to be a "beverage container" 11 having an opening of any diameter. In some embodiments, the dispensing devices can be configured for engagement with bottles 11 having a wide diameter opening. For example, the dispensing devices disclosed herein can be configured to engage with a bottle 11 having an opening with a diameter in the range of 2 to 5 centimeters.

The dispensing devices disclosed herein can be used with any beverage ingredient formulation including powdered material, granular material, tablets and even a liquid formulation that can be contained within a sealed chamber which can be considered to be an "internal volume" of the dispensing device 10. By way of example, the sealed chamber can be capable of containing up to 40 grams of formulation and suitably in the range of 20 to 30 grams of formulation. Other amounts can also be used.

Figure 2:
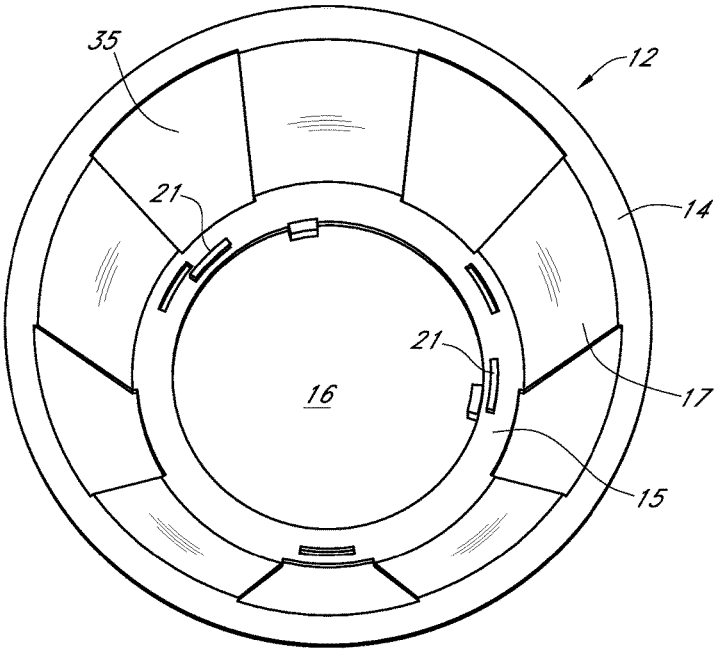
FIG. 2 is a plan view of the supporting assembly shown in FIG. 1 in which the supporting assembly has been removed from the bottle, and the cartridge has been removed.
Figure 3:
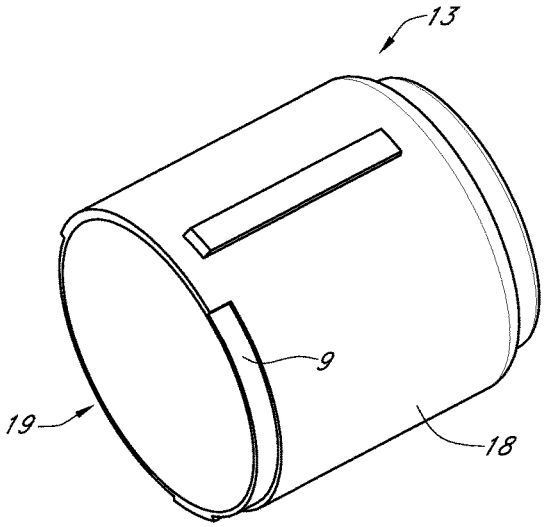
FIG. 3 is a bottom and side perspective view of the cartridge shown in FIG. 1 that has been removed from the bottle and the supporting assembly.

FIGS. 1 to 3 illustrate a dispensing device 10 according to an embodiment which includes a supporting assembly 12 that engages the bottle 11 and a replaceable cartridge 13 that is seated on the supporting assembly 12. The supporting assembly 12 can include an outer annular flange 14 that can be fixed to an upper rim of an opening of the bottle 11 and an inner annular flange 15 that can be connected to the outer annular flange 14 by five bridging members 17 extending between the inner and outer flanges 14 and 15. Alternatively, the inner annular flange 15 can be connected to the outer annular flange 14 by a different number of bridging members 17, such as one, two, three, four, five, six, or seven or more bridging members 17. Gaps 35 can exist between the one or more bridging members 17. The outer annular flange 14 can be fixed to the upper rim of the bottle 11 using any suitable means including plastics welding or by means of an adhesive.

As illustrated in FIG. 1, the bridging members 17 are configured so as to locate the inner annular flange 15 at a spacing from the opening of the bottle 11.

With reference to FIG. 3, the cartridge 13 can include a receptacle shaped body 18 having a cylindrical sidewall defining a circular opening 19 at one end and a top wall including a rotatable dial 20, as illustrated in FIG. 1. During a preliminary manufacturing step, an opening mechanism (not shown in FIGS. 1 to 3) that is operated by the rotatable dial 20 can be preinstalled into the receptacle body 18, and the formulation can be loaded into the receptacle body 18. A sealing membrane 50 can be fixed to the opening 19 to form a sealed chamber containing a known quantity of the formulation and the opening mechanism.

Although not shown in the figures, the opening mechanism can include a first screw thread that cooperates with a second screw thread on the inside surface of the receptacle body 18, when a user turns the dial 20. Thus, when a user turns the dial 20, the second screw thread can cooperate with the first screw thread on the opening mechanism and cause the opening mechanism to open the sealing membrane 50 wherein the formulation in the sealed chamber is released.

When in use, the end of the cartridge 13 having the opening 19 can be seated on the inner annular flange 15 of the supporting assembly 12 so that the cartridge 13 is predominantly accommodated or positioned below the opening of the bottle 11 and can be entirely within the bottle 11 or below the opening of the bottle 11. As such, the inner annular flange 15 can be considered as defining a stop preventing the beverage ingredient cartridge 13 from falling into the bottle 11.

In order to prevent relative rotational movement between the cartridge 13 and the supporting assembly 12, the cartridge 13 and supporting assembly 12 can include cooperating formations. For example, the cylindrical sidewall adjacent to the opening 19 of the cartridge 13 includes indentations 9 that can receive projections 21 extending from the inner annular flange 15 of the supporting assembly 12. The cartridge 13 can include projections that are received by openings or indentations in the supporting assembly 12. When the formations interfit, relative rotational movement between the cartridge 13 and the supporting assembly 12 is prevented, such that rotation of the dial 20 operates the opening mechanism and does not simply turn the cartridge 13 on the supporting assembly 12.

Ideally, the outer annular flange 14 can be fixed to the rim of the bottle 11, for example, by plastics welding or by glue.

Although not shown in FIG. 1, the bottle 11 and the dispensing device 10 can also be fitted with a closure cap that can be screwed onto the bottle 11. The closure cap can be any suitable closure, such as a teat cap for feeding a baby, a convention closed end cap, or a sports bottle cap having a push and pull nozzle.

Figure 4:
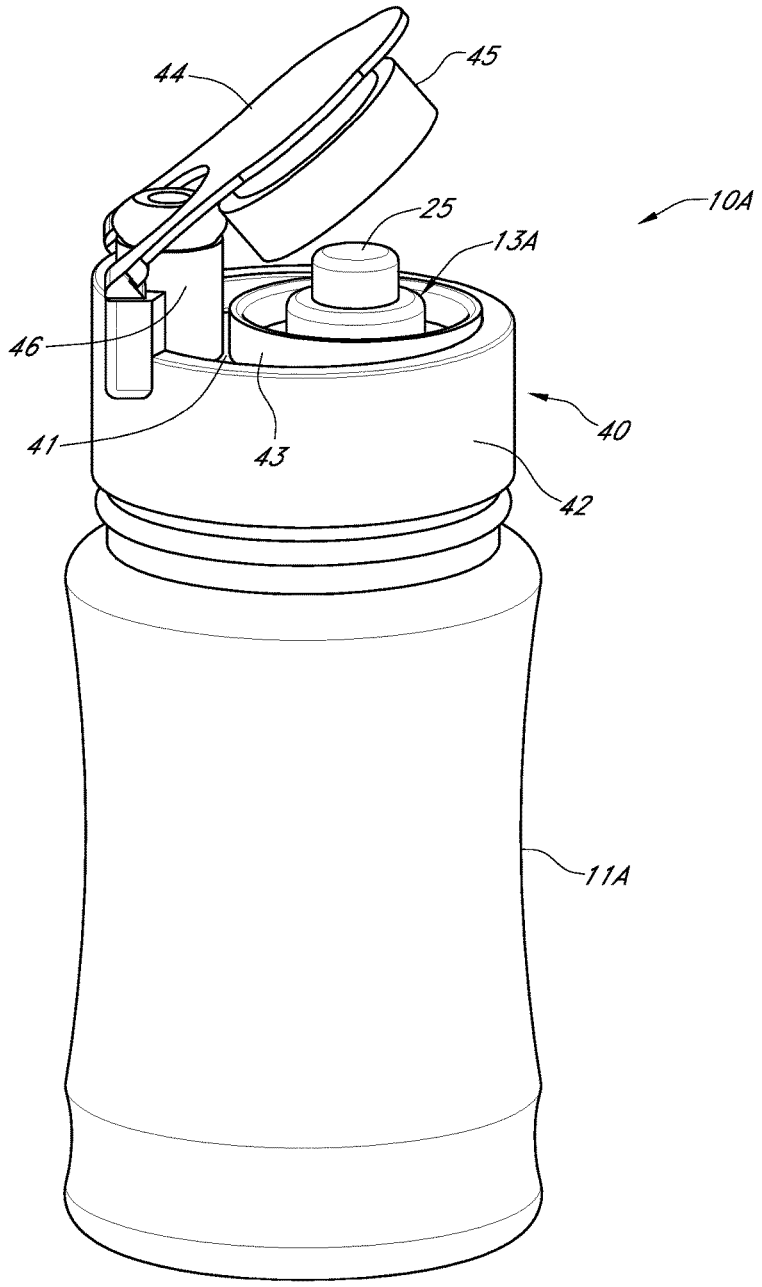
FIG. 4 is a side and top perspective view of a dispensing device according to another embodiment including an internal support structure, and external closure and a separable cartridge that are fitted to the upper opening of a bottle.
Figure 5A:
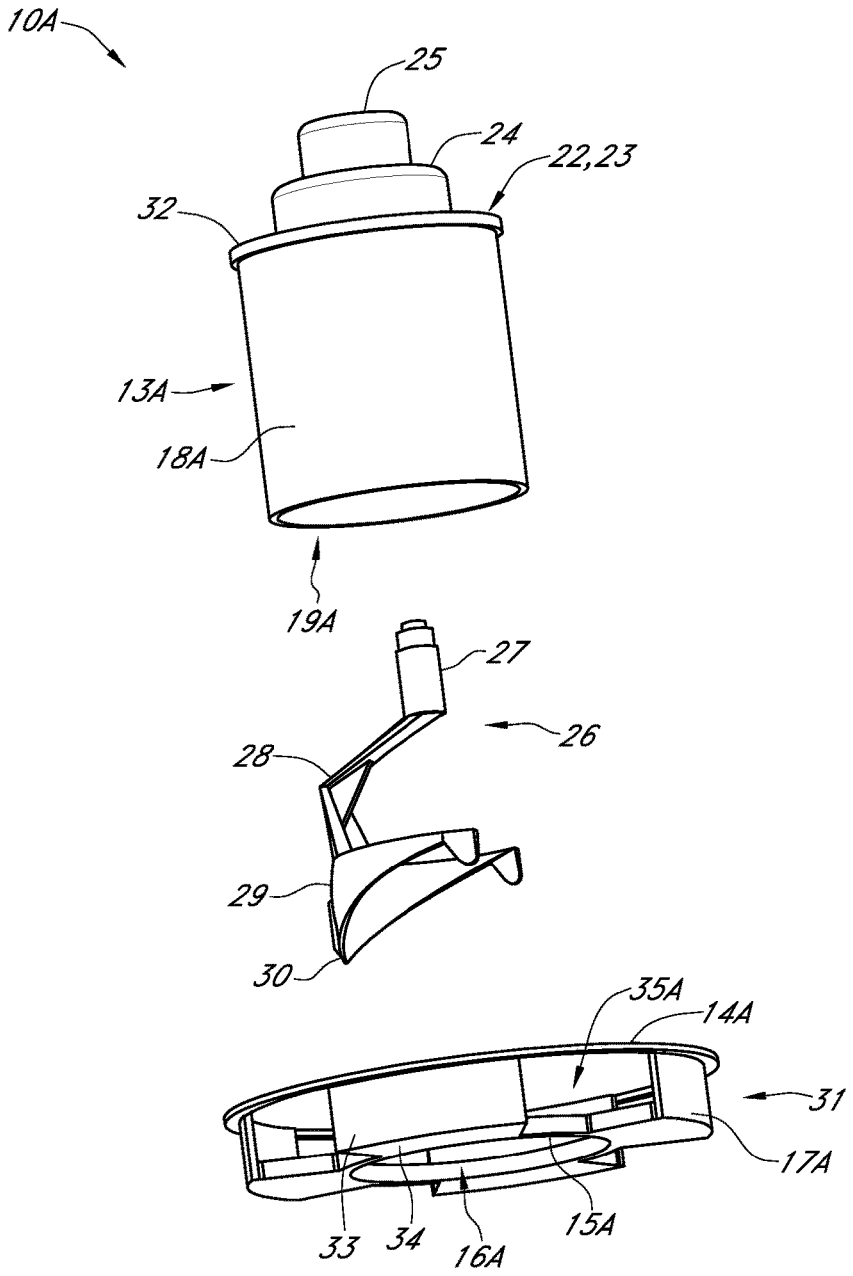
FIG. 5A is an exploded view of the inner supporting assembly and cartridge shown in FIG. 4 removed from a bottle.
Figure 5B:
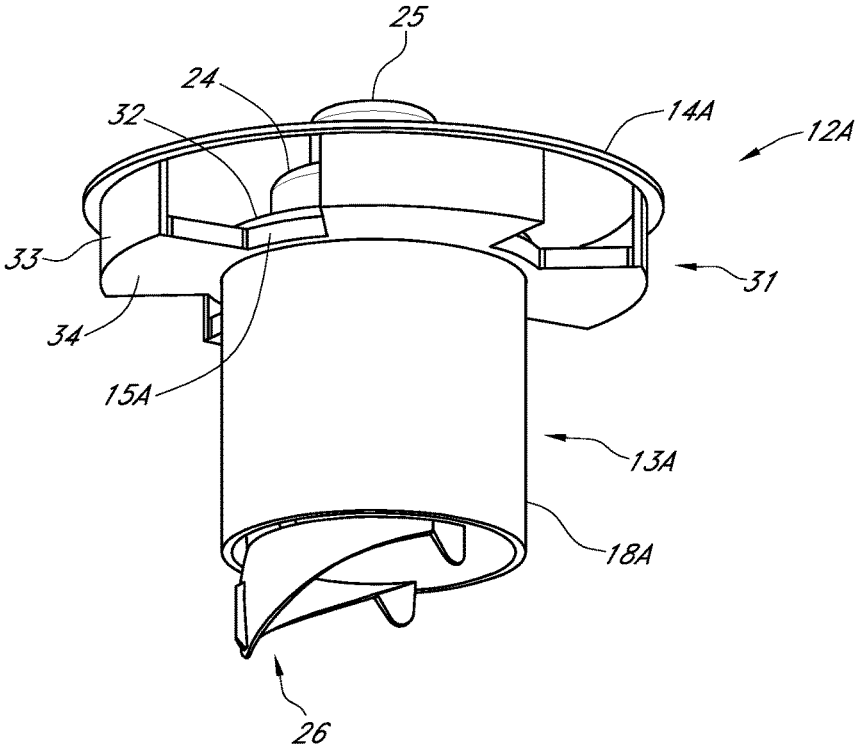
FIG. 5B is a perspective view of the inner supporting assembly and cartridge shown in FIG. 5A fitted together.

FIGS. 4, 5A and 5B illustrate a dispensing device 10A according to another embodiment which can be fitted to a bottle 11A for treating the contents of the bottle 11A with a formulation. The parts, components, and features of the dispensing device 10A that are similar or the same as corresponding parts, components, and features of the dispensing device 10 are identified with the same reference numerals, except that an "A" has been added thereto. The dispensing device 10A includes a supporting assembly 12A including an inner body 31 and a cartridge 13A that can contain a formulation. The cartridge 13A of this embodiment can be similar to the cartridge 13 used with the previously-discussed embodiment, save for a number of differences the majority of which will now be described.

Figure 5C:
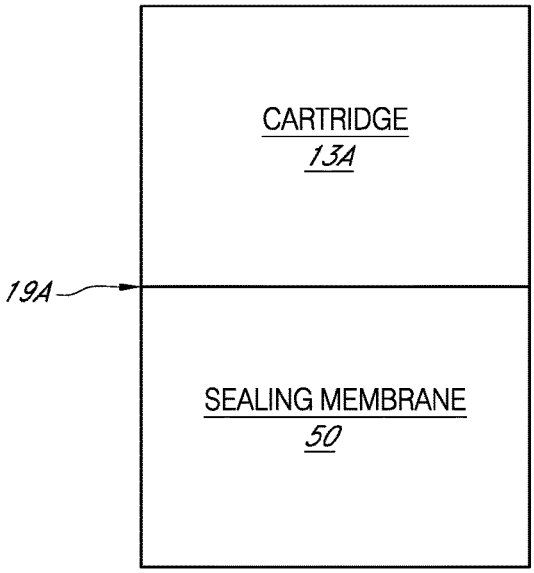
FIG. 5C illustrates a sealing membrane sealed to the opening of the cartridge.

The cartridge 13A of this embodiment can include a receptacle body defined by a cylindrical wall 18A having an end with an opening 19A and an opposite top wall 22 having an outer peripheral region 23, a step formation 24 and a button 25 centrally located on the top wall 22 which protrudes above the step formation 24. The button 25 is shown in a raised unpressed position in the FIGS. 4 and 5A. The cartridge 13A also can include an opening mechanism 26 that can be located inside the cartridge 13A during the manufacturing or filling process and during the dispensing process. The opening mechanism 26 can have a head 27 which engages on inside face of the button 25, a leg 28 extending from the head 27, and a foot portion 29 arranged to extend about part of the inner circumference of the cartridge 13A. In some alternative embodiments, the leg 28 can have an L-shape (see FIG. 5A). The foot portion 29 can have curved sides that complement the circumference of the cartridge 13A which converge to form a centralized point 30 on a loading bearing edge of the foot portion 29. With reference to FIG. 5C, a sealing membrane 50 can be adhered or welded to the open end 19A of the receptacle to form a sealed chamber containing the formulation and the opening mechanism 26.

The head 27, leg 28, and foot portion 29 of the opening mechanism 26 can be sized such that the head 27 engages the button 25 of the cartridge 13A when the button 25 is in the raised position, and a user on the pressing the button 25 can cause the opening mechanism 26 to be advanced toward the sealing membrane 50, and break the membrane 50 so as to discharge the formulation.

As can be seen in FIGS. 5A and 5B, the inner body 31 of the supporting assembly 12A of the an embodiment includes an outer annular flange 14A, for engaging the opening of the bottle, and an inner flange 15A that defines an inner aperture 16A. The inner aperture 16A can be sized to receive the cylindrical sidewall 18A of the cartridge 13A, as shown in FIG. 5B. The outer flange 14A and the inner flange 15A can be interconnected by one or more bridging members 17A having a first limb 33 extending downward and a second limb 34 extending inwardly. For example, the outer flange 14A and the inner flange 15A can be interconnected by one, two, three, four, five, six, seven, or eight or more bridging members 17A having a first limb 33 extending downward and a second limb 34 extending inwardly. The bridging members 17A can be L-shaped. The bridging members 17A can be spaced from each other by gaps 35A.

As shown in FIG. 5B, a user can position the cartridge 13A in the opening 16A of the supporting assembly 12A with an outer lip formation 32 of the cartridge 13A being seated on the inner flange 15A of the supporting assembly 12A.

In FIG. 4 the outer flange 14A of the inner body 31 can be seated on an opening of the bottle 11A, the cartridge 13A being received by the inner body 31, and dispensing device 10A also including a removable closure cap 40 being fitted over the inner body 31. The closure cap 40 can have a top wall which can also be considered to be a "top surface" 41 and an outer skirt 42 which can also be considered to be an "outer wall" 42 extending from the top wall 41, the outer skirt 42 can have an inwardly facing screw thread for cooperating with the thread on the neck of the bottle 11A. The top wall 41 can have an aperture that aligns with the press button 25 of the cartridge 13A. For example, the aperture in the top wall 41 of the closure cap 40 can be sized to allow the cartridge 13A to pass through the aperture to allow the cartridge 13A to be replaced with a fresh cartridge as desired. The top wall 41 of the closure cap 40 can include a collar 43 extending upwardly from the aperture and around a perimeter of the aperture.

As illustrated in FIG. 4, the closure cap 40 can include a pivoting lever 44 which can be pressed by a user so as to engage and press the press button 25 of the cartridge 13A and break the seal of the sealing membrane 50. The inside face of the pivoting lever which can be considered to be a "cover" or "lid" 44, can include a skirt 45 extending around a perimeter of the pivoting lever 44 that can make a sealing engagement with the collar 43 extending from the top wall 41 of the closure cap 40 to allow the bottle 11A to be inverted during consumption without leakage through the aperture in the top wall 41. In addition, a lower end of the skirt 45 of the pivoting lever 44 can further press the outer peripheral region 23 of the top wall 22 of the cartridge 13A onto the inner annular flange 15A of the inner body 31 of the supporting assembly 12A, thereby further sealing the contents of the bottle 11A when the pivoting lever 44 is pressed.

As can be seen, the closure cap 40 can include a nozzle, which can also be considered to be a "drink through valve" 46 having a push pull closure to allow a user to consume the contents of the bottle 11A. The drink through valve 46 can include a stem and a valve member movably mounted to the stem between opened and closed positions. The stem of the drink through valve 46 can include a passage extending through the top wall 41 and a valve opening, wherein the valve member closes the valve opening when in the closed position and is spaced from the passage when in the open position. The stem and valve member of the drink through valve 46 can define a push pull closure to allow contents from the beverage container to pass through the drink through valve 46 when the push pull closure is in the open position and prevent contents from the beverage container from passing through the drink through valve 46 when the push pull closure is in the closed position. The drink through valve 46 can be positioned on the top wall which can also be considered to be a "top surface" 41 of the closure cap 40 spaced from the aperture on the top wall 41. The gaps 35A between the one or more bridging members 17A allow the contents of the bottle 11A to flow into and through the nozzle 46.

In some embodiments, the dispensing device 10A can include a removable closure cap 40 that comprises a unitary structure with the supporting assembly 12A and/or the inner body 31. In other words, the removable closure cap 40 can accommodate and or secure the cartridge 13A and position the cartridge 13A, when placed within the aperture in the top wall 41, to allow ingredients from within the cartridge 13A to flow into the bottle 11A. For example, the dispensing device 10A can include a top wall 41, a cartridge receptacle for containing a cartridge 13A, a nozzle 46, and a pivoting lever 44. The cartridge receptacle can comprise an upper end near the top wall 41 including a first aperture having a perimeter and being located on the top wall 41, a lower end including a second aperture, and an interior sidewall defining an internal volume between the upper and lower ends that can accommodate and/or secure the cartridge 13A. The cartridge receptacle can include an inner flange 15A positioned at the lower end and proximate to the second aperture. The inner flange 15A, as shown in FIG. 5B, can define a stop preventing the cartridge 13A from falling through the lower end of the cartridge receptacle into an internal volume of the bottle 11A. The internal sidewall of the cartridge receptacle can be cylindrical and thus sized to accommodate a cylindrical beverage ingredient cartridge (see FIG. 4). The lower end of the cartridge receptacle can be configured to allow a beverage ingredient or formulation in the cartridge 13A to flow through the second aperture and into the bottle 11A.

The nozzle 46 of this embodiment can have a push pull closure to allow a user to consume the contents of the bottle 11A. The nozzle 46 can include a stem and a valve member movably mounted to the stem between opened and closed positions. The stem of the drink through valve 46 can include a passage extending through the top wall 41 and a valve opening, wherein the valve member closes the valve opening when in the closed position and is spaced from the passage when in the open position. The stem and valve member of the drink through valve 46 can define a push pull closure to allow contents from the beverage container to pass through the drink through valve 46 when the push pull closure is in the open position and prevent contents from the beverage container from passing through the drink through valve 46 when the push pull closure is in the closed position. The drink through valve 46 can be positioned on the top wall 41 of the closure cap 40 spaced from the aperture on the top wall 41.

The pivoting lever 44 of this embodiment can be configured to pivot between open and closed positions and can include a skirt 45 extending around a perimeter of the pivoting lever 44. The skirt 45 can form a sealing engagement with a collar 43 extending from the top wall 41 of the closure cap 40 to allow the bottle 11A to be inverted during consumption without leakage through the aperture in the top wall 41. In accordance with some embodiments, the pivoting lever 44 can be pivotably mounted to the top wall 41 at a connection location and the drink through valve 46 can be positioned closer to the aperture in the top wall 41 than to the connection location. Alternatively, the drink through valve 46 can be positioned close to the connection location than to the aperture in the top wall 41.

This embodiment of the dispensing device 10A can include an outer skirt which can be considered to be an "outer wall" 42 that can have an inwardly facing surface with a screw thread for cooperating with the screw thread of a bottle 11A. The inwardly facing surface of the outer skirt 42 can be configured to engage a top portion of a bottle 11A with other securement or sealing methods or structures. The outer skirt 42 of the dispensing device 10A can comprise different shapes. For example, the outer skirt 42 can be cylindrical. In accordance with some embodiments, the outer skirt 42 extending downwardly from the top wall 41 of the dispensing device 10A and the top portion of the bottle 11A can be cylindrical.

In this embodiment, the cartridge receptacle can be configured to accommodate and/or secure a beverage ingredient cartridge 13A that comprises a cartridge body 18A defining an internal volume (see, e.g., FIG. 3), a cartridge opening 19A, and a frangible sealing membrane 50 that covers the cartridge opening 19A and seals the internal volume defined by the cartridge body 18A. As discussed previously, the internal volume defined by the cartridge body 18A can include up to 40 grams of formulation, for example, in the range of 20 to 30 grams of formulation. In some embodiments, the cartridge 13A can be removable from the cartridge receptacle of the removable closure cap 40.

Figure 6:
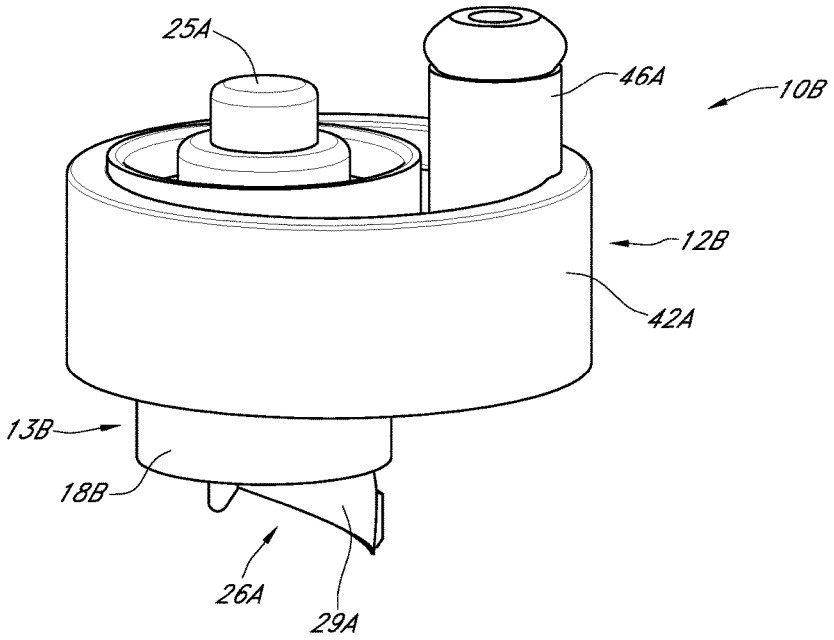
FIG. 6 is a perspective view of a dispensing device according to another embodiment including a supporting assembly for supporting cartridge and for attaching the dispensing device to a bottle, in which the supporting assembly and cartridge are integrally formed.
Figure 7:
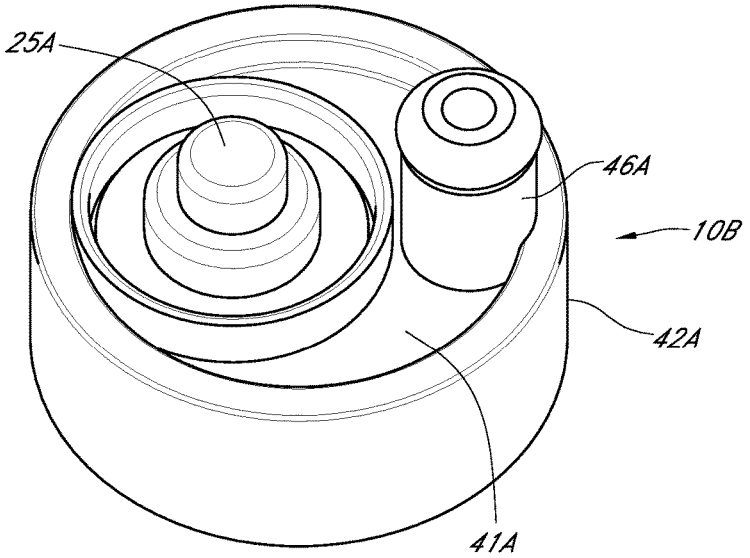
FIG. 7 is a top perspective view of the dispensing device shown in FIG. 6.

FIGS. 6 and 7 illustrate a dispensing device 10B according to another embodiment which can be fitted to a bottle for treating the contents of a bottle (not shown in FIG. 6 or 7) with a formulation. The parts, components, and features of the dispensing device 10B that are similar or the same as corresponding parts, components, and features of the dispensing device 10 are identified with the same reference numerals, except that a "B" has been added thereto. Unlike the embodiments shown in FIGS. 1 to 5B which allow the cartridge 13 or 13A to be interchanged with a fresh cartridge as required, the embodiment shown in FIGS. 6 and 7 comprises the supporting assembly 12B and cartridge 13B being a unitary structure which requires the device 10B to be a one-use-only device. Once the formulation has been discharged from the device 10B, and the contents of the bottle consumed, it is envisaged that the dispensing device 10B can be recycled using conventional plastic melting techniques.

The dispensing device 10B shown in FIGS. 6 and 7 includes a supporting assembly that engages the neck of a bottle and is fixedly interconnected to the cartridge 13B, for example, by means of integral molding or the cartridge 13B being plastics welded to the supporting assembly 12B. The cartridge 13B of this embodiment is similar to the cartridge used with the previous embodiments, save for the cartridge 13B of this embodiment being fixedly connected to the supporting assembly 12B. The cartridge 13B can also loaded with the desired formulation to be dispensed by the dispensing device 10B.

The supporting assembly 12B of this embodiment can include a top wall 41A and an outer skirt 42A extending from the top wall 41A about an outer perimeter of the top wall 41A, and an inner skirt formation 18B extending from the top wall 41A at a spacing from the outer skirt 42A. The outer skirt 42A can have an inwardly facing surface with a screw thread for cooperating with the screw thread of a bottle 11 or 11A. The inwardly facing surface of the outer skirt 42A can be configured to engage a top portion of a bottle with other securement or sealing methods or structures. The outer skirt 42A of the dispensing device 10B can comprise different shapes. For example, the outer skirt 42A can be cylindrical. In accordance with some embodiments, the outer skirt 42A extending downwardly from the top wall 41A of the dispensing device 10B and the top portion of the beverage container can be cylindrical. The inner skirt formation 18B can be positioned asymmetrically on the top wall 41A and together with the top wall 41A defines a receptacle body for receiving the formulation and an opening mechanism 26A. A press button 25A can be located in the top wall 41A of the receptacle body which a user can press to operate the opening mechanism 26A.

The opening mechanism 26A of this embodiment can be the same as the opening mechanism 26 of the previously-discussed embodiments (shown in FIG. 5A). In other words, the opening mechanism 26A can have a head 27 which engages on inner surface of the button 25, a leg 28 extending from the head 27, and a foot portion 29A arranged to extend about part of the inner circumference of the cartridge 13B. The head 27, leg 28 and foot portion 29A of the opening mechanism 26 can be sized such that the head 27 engages the button 25A of the cartridge 13B when the button 25A is in the raised position, and a user on upon pressing the button 25A can cause the opening mechanism 26A to be advanced toward a sealing membrane 50. The sealing membrane can be adhered or welded to the open end of the inner skirt formation 18B to form a sealed chamber containing the formulation and the opening mechanism 26A.

Although not shown in the figures, a lower end of the button 25A can slidably engage to an inside surface of the top wall 41A of the supporting assembly and can form a liquid seal therewith. For example, the lower end of the button 25A can include an O-ring that sealingly engages the inside of the top wall 41A when the button 25A is in an operating position.

As can be seen, the device 10B can include a nozzle 46A having a push pull closure to allow a user to consume the contents of the bottle. The drink through valve 46A can be similar to that those in previously-described embodiments. The nozzle 46A can open directly into the neck of the bottle 11 or 11A and allow the contents of the bottle 11 or 11A to be consumed.

Those skilled in the art will appreciate that many variations and modifications can be made to the embodiments described above without departing from the spirit and scope of the present inventions. For example, the outer skirt of the dispensing device shown in FIGS. 4, 6 and 7 can include a tamper evidence band which is frangibly connected to a lower end of the outer skirt which is retained on the bottle when the dispensing device is removed from the bottle.

What is claimed is:

1. A beverage container and dispensing device comprising:

a beverage container comprising a body and a top portion having a first opening defining a first internal volume, the beverage container configured to contain a liquid beverage;

a removable lid assembly configured to secure to the top portion of the beverage container and over the first opening, the removable lid assembly comprising:

a top surface;

a cartridge receptacle comprising an upper end including a first aperture having a perimeter and being located on the top surface, a lower end including a second aperture, and a cylindrical sidewall defining a second internal volume between the upper and lower ends, the cartridge receptacle further comprising an inner flange positioned at the lower end and proximate to the second aperture;

a beverage ingredient cartridge comprising a cartridge body defining a third internal volume, a cartridge opening, and a frangible sealing membrane that covers the cartridge opening and seals the third internal volume defined by the cartridge body, the third internal volume containing a formulation of beverage ingredients mixable with liquid contents of the beverage container;

wherein the second internal volume and the first aperture being sized to allow the beverage ingredient cartridge to be inserted through the first aperture and into the second internal volume, the cartridge receptacle being configured to allow a beverage ingredient in the beverage ingredient cartridge to flow through the second aperture and into the beverage container, the inner flange defining a stop preventing the beverage ingredient cartridge from falling through the lower end of the cartridge receptacle into the first internal volume of the beverage container;

a collar extending upwardly from the top surface and around the perimeter of the first aperture of the upper end of the cartridge receptacle;

an outer wall extending downwardly from the top surface and comprising an inwardly facing surface configured to engage the top portion of the beverage container;

a drink through valve comprising a stem and a valve member movably mounted to the stem between opened and closed positions, the stem comprising a passage extending through the top surface and a second opening, the valve member closing the second opening when in the closed position and being spaced from the passage when in the open position, the stem and valve member defining a push pull closure to allow contents from the beverage container to pass through the drink through valve when the push pull closure is in the open position and prevent contents from the beverage container from passing through the drink through valve when the push pull closure is in the closed position, the drink through valve positioned on the top surface of the removable lid assembly spaced from the first aperture on the top surface;

a cover pivotably mounted to the top surface of the removable lid assembly configured to pivot between open and closed positions, the cover comprising a cover perimeter and a skirt extending around the cover perimeter, wherein when the cover is in the closed position, the cover covers the first aperture on the top surface and the skirt is configured to engage the collar on the top surface and form a sealing engagement which allows the beverage container to be inverted during consumption without leakage through the first aperture.

2. The beverage container and dispensing apparatus of claim 1, wherein the inwardly facing surface of the outer wall comprises a screw thread for engaging to a corresponding screw thread located on the top portion of the beverage container.

3. The beverage container and dispensing apparatus of claim 1, wherein the cartridge is removable from the lid assembly.

4. A dispensing device for dispensing a formulation into a beverage container, comprising:

a top surface;

a cartridge receptacle comprising an upper end including a first aperture having a perimeter and being located on the top surface, a lower end including a second aperture, and a cylindrical sidewall defining a first internal volume between the upper and lower ends, the cartridge receptacle further comprising an inner flange positioned at the lower end and proximate to the second aperture;

a collar extending upwardly from the top surface and around the perimeter of the first aperture of the upper end of the cartridge receptacle;

an outer wall extending downwardly from the top surface and comprising an inwardly facing surface configured to engage a top portion of the beverage container;

a drink through valve comprising a stem and a valve member movably mounted to the stem between opened and closed positions, the stem comprising a passage extending through the top surface and a first opening, the valve member closing the first opening when in the closed position and being spaced from the passage when in the open position, the drink through valve positioned on the top surface spaced from the first aperture; and a lid pivotably mounted to the top surface and configured to pivot between open and closed positions, wherein in the closed position the lid covers the first aperture and is spaced from the drink through valve and does not cover the drink through valve.

5. The dispensing device of claim 4, further comprising a beverage ingredient cartridge comprising a cartridge body defining a second internal volume, a cartridge opening, and a frangible sealing membrane that covers the cartridge opening to seal the second internal volume, the sealed second internal volume containing a formulation to be added to the beverage container.

6. The dispensing device of claim 5, wherein the second internal volume of the cartridge body of the beverage ingredient cartridge includes between 5 and 30 grams of the formulation.

7. The dispensing device of claim 4, wherein the inner flange of the cartridge receptacle defines a stop preventing a beverage ingredient cartridge from falling through the lower end of the cartridge receptacle into the beverage container when the beverage ingredient cartridge is retained within the first internal volume of the cartridge receptacle.

8. The dispensing device of claim 4, wherein the lid comprises a skirt extending around a lid perimeter, the skirt configured to engage the collar when the lid is in the closed position and form a seal to prevent leakage through the first aperture when the beverage container is inverted during consumption.

9. The dispensing device of claim 4, wherein the inwardly facing surface of the outer wall comprises a screw thread for engaging to a corresponding screw thread located on a top portion of the beverage container.

10. The dispensing device of claim 4, wherein the lid is pivotably mounted to the top surface at a connection location, and wherein the drink through valve is positioned closer to the first aperture than to the connection location.

11. The dispensing device of claim 4, wherein the outer wall extending downwardly from the top surface of the dispensing device and the top portion of the beverage container are cylindrical.

12. A dispensing device for dispensing a formulation into a beverage container, comprising:

a top surface;

a cartridge receptacle comprising an upper end including a first aperture having a perimeter and being located on the top surface, a lower end including a second aperture, and an interior sidewall defining a first internal volume between the upper and lower ends, the cartridge receptacle further comprising an inner flange positioned at the lower end and proximate to the second aperture;

a drink through valve comprising a stem and a valve member movably mounted to the stem between opened and closed positions, the stem comprising a passage extending through the top surface and a first opening, the valve member closing the first opening when in the closed position and being spaced from the passage when in the open position, the drink through valve positioned on the top surface spaced from the first aperture; and a lid pivotably mounted to the top surface and configured to pivot between open and closed positions, wherein in the closed position the lid covers the first aperture and is spaced from the drink through valve and does not cover the drink through valve.

13. The dispensing device of claim 12, wherein the inner flange of the cartridge receptacle defines a stop preventing a beverage ingredient cartridge from falling through the lower end of the cartridge receptacle into the beverage container when the beverage ingredient cartridge is retained within the first internal volume of the cartridge receptacle.

14. The dispensing device of claim 12, further comprising a collar extending upwardly from the top surface and around the perimeter of the first aperture of the upper end of the cartridge receptacle.

15. The dispensing device of claim 14, wherein the lid comprises a skirt extending around a lid perimeter, the skirt configured to engage the collar when the lid is in the closed position and form a seal to prevent leakage through the first aperture when the beverage container is inverted during consumption.

16. The dispensing device of claim 12, wherein the lid is pivotably mounted to the top surface at a connection location, and wherein the drink through valve is positioned closer to the first aperture than to the connection location.

17. The dispensing device of claim 12, further comprising an outer wall extending downwardly from the top surface, the outer wall comprising an inwardly facing surface configured to engage a top portion of the beverage container.

18. The dispensing device of claim 17, wherein the inwardly facing surface of the outer wall comprises a screw thread for engaging to a corresponding screw thread located on the top portion of the beverage container.

19. The dispensing device of claim 17, wherein the outer wall extending downwardly from the top surface and the top portion of the beverage container are cylindrical.

20. The dispensing device of claim 12, wherein the interior sidewall of the cartridge receptacle is cylindrical, sized and shaped to accommodate a cylindrical beverage ingredient cartridge.

* * * * *